US007853133B2

(12) United States Patent
Reusche et al.

(10) Patent No.: US 7,853,133 B2
(45) Date of Patent: Dec. 14, 2010

(54) DEICING SYSTEM AND METHOD

(75) Inventors: Thomas K. Reusche, Elburn, IL (US); Philip E. Chumbley, Aurora, IL (US)

(73) Assignee: Allied Precision Industries, Inc., Elburn, IL (US)

( * ) Notice: Subject to any disclaimer, the term of this patent is extended or adjusted under 35 U.S.C. 154(b) by 798 days.

(21) Appl. No.: 11/757,809

(22) Filed: Jun. 4, 2007

(65) Prior Publication Data

US 2008/0002955 A1 Jan. 3, 2008

Related U.S. Application Data

(60) Provisional application No. 60/811,527, filed on Jun. 7, 2006.

(51) Int. Cl.
*H05B 3/80* (2006.01)

(52) U.S. Cl. ..... 392/499; 392/497; 392/471

(58) Field of Classification Search ..... 392/499, 392/497, 471
See application file for complete search history.

(56) References Cited

U.S. PATENT DOCUMENTS 5,235,161 A * 8/1993 Reusche et al. ..... 219/523
6,707,988 B2 * 3/2004 Reusche et al. ..... 392/455
6,778,763 B1 8/2004 Reusche et al.

* cited by examiner

*Primary Examiner*—Thor S Campbell
(74) *Attorney, Agent, or Firm*—McAndrews, Held & Malloy, Ltd.

(57) ABSTRACT

A deicing system configured to heat water within a water receptacle includes a main body supporting a temperature sensor, a heating element, and a pump. The main body is positioned proximate a base of the water receptacle. The temperature sensor is configured to detect the temperature of the water. The heating element is configured to heat the water when a temperature of the water approaches a freezing point. The pump is configured to circulate the water within the water receptacle to prevent temperature gradients within the water.

21 Claims, 2 Drawing Sheets

DEICING SYSTEM AND METHOD

RELATED APPLICATIONS

The present application relates to and claims priority from U.S. Provisional Application No. 60/811,527, entitled "Deicer With Convection Pump," filed Jun. 7, 2006, which is also hereby incorporated by reference in its entirety.

FIELD OF THE INVENTION

Embodiments of the present invention generally relate to a deicing system and method, and more particularly to a deicing system and method that circulates fluid within a fluid receptacle in order to uniformly disperse heated water and reduce or eliminate temperature gradients within the fluid.

BACKGROUND OF THE INVENTION

Conventional electric water deicers are used to keep areas of livestock water tanks and ponds free from ice during winter months. One type of deicer is a floating deicer in which a buoyant member such as a buoyant ring is attached to a heating element so that the deicer may float on the surface of the water. Another type of deicer is a sinking deicer that is configured to lay at the bottom of a tank or pond, or on a metal guard submerged in the tank. A drain plug deicer is yet another type of deicer that is mounted through a drain hole of a tank and operates similar to a sinking deicer.

As water cools, it becomes denser until it reaches a temperature of approximately 4° C., at which point it begins to expand again. The expansion causes the coolest water to rise to the surface of a tank where it freezes at 0° C. Likewise, as water is heated above 4° C. by a deicer, the warm water rises to the surface. The continual supply of warm water provided by a deicer prevents the surface of the water from freezing over. Such a deicing effect may be accomplished by continually operating a heater in water. Deicers, on the other hand, typically include a temperature sensor (e.g., a thermostat) that detects when the water temperature rises above a freezing point. A typical deicer then deactivates a heating element when water is not susceptible to freezing in order to conserve energy. When the temperature sensor detects that the water temperature is at or close to the freezing point, the deicer re-activates the heating element in order to heat the water.

A floating deicer only heats proximate a water surface. The warmer water forms a layer on top of the colder water at the bottom of the tank or pond. As such, the floating deicer operates as if it is only heating a smaller body of water at the top of the tank or pond, as opposed to the entire tank or pond. A floating deicer may come into contact with livestock that drink from the tank. Horses, in particular, are known to bite objects and lift them out of tanks. Additionally, an animal may be burned if it contacts a hot heating element.

A sinking deicer is submerged in a water tank or pond and is, therefore, beyond the reach of most animals. Due to the fact that the sinking deicer lies at the bottom of the water receptacle, however, the sinking deicer is configured to heat the entire body of water, instead of just the top layer that is susceptible to freezing. As the sinking deicer heats the water, the warmer water flows to the surface thereby displacing the colder water downward. Thus, in order for the temperature sensor within the deicer to detect the presence of warmed water, the heater remains activated until the entire volume of water above the deicer is warmed water. As such, a sinking deicer is typically activated much longer than a floating deicer. Consequently, a typical sinking deicer requires more energy to operate than a typical floating deicer.

Additionally, as a tank of water cools, the water contained within the tank may form a significant temperature gradient between the top and the bottom of the tank. Because water is at its densest at 4° C., the dense water remains at the bottom of the tank as the surface water cools. Thus, the surface of the water may be at 0° C. while the deicer at the bottom of the tank detects a water temperature of 4° C. This situation is exacerbated by the fact that the heat in a still tank travels via conduction, which may be a slow process.

In order to overcome a delayed heating trigger, typical sinking deicers are configured to activate heating elements at around 5°-6° C. As water is heated, the warmed water flows upward displacing colder water downward. As such, the temperature gradient may be more pronounced with a difference of over 10° C. between the top and bottom of the tank. For example, a sinking deicer set to activate at 11° C. may deactivate while the surface temperature is actually around 21° C. or higher. Thus, typical sinking deicers waste energy due to the fact that they usually heat water long after the threat of freezing has been overcome.

Typical drain plug deicers provide the same advantages and disadvantages of sinking deicers discussed above. Unlike a sinking deicer, however, a typical drain plug deicer includes an electrical cord that is disposed completely outside of the fluid receptacle. Much like a sinking deicer, however, a typical drain plug deicer excessively heats the water within the receptacle, thereby wasting energy.

As discussed above, sinking and drain plug deicers are less efficient than floating deicers. Sinking and drain plus deicers are, however, safer to use in the presence of livestock and other animals.

SUMMARY OF THE INVENTION

Certain embodiments of the present invention provide a deicing system configured to heat water within a water receptacle, such as a water tank, bucket, or the like. The system includes a temperature sensor, a heating element, and a pump.

Certain embodiments of the present invention provide a deicing system configured to heat water within an open-ended water receptacle that includes a base integrally connected to outer walls. The deicing system is configured to be positioned proximate the base of the open-ended water receptacle.

The deicing system includes a main body configured to be positioned proximate the base of the open-ended water receptacle. The main body supports a temperature sensor, a heating element and a pump.

The temperature sensor is configured to detect a temperature of the water. The heating element is configured to heat the water when the temperature of the water approaches a first temperature threshold as measured by the temperature sensor. The heating element is configured to deactivate when the temperature of the water exceeds a second temperature threshold as measured by the temperature sensor, wherein the second temperature threshold is higher than the first temperature threshold.

The pump is configured to circulate the water within the water receptacle to prevent temperature gradients within the water.

The system may be configured to be submerged in the water receptacle. Optionally, the system may be configured to be sealingly secured within a drain of the water receptacle.

The pump may include a water intake configured to draw the water into the pump, and a water outlet configured to eject the water. The water outlet may be upwardly directed to facilitate efficient water circulation. The pump may be configured to run when the heating element is activated and deactivated The water receptacle may be a livestock water trough. Unlike floating deicers, animals are unlikely to come into contact with the deicing system because it is configured to be positioned proximate a bottom or base of the water receptacle.

A switch may be disposed between the heating element and the temperature sensor. The heating element may be a heater coil, while the temperature sensor may be a thermostat.

Certain embodiments of the present invention provide a system for preventing ice from forming on a surface of water. The system includes an open-ended water receptacle and a deicer.

The open-ended water receptacle includes a base integrally connected to outer walls, wherein a water retention cavity is defined between the base and the outer walls. The open-ended water receptacle is configured to retain water within the water retention cavity.

The deicer is positioned proximate the base and is configured to maintain the water at a uniform temperature within the open-ended water receptacle. The deicer includes a main body that supports a temperature sensor, a heating element, and a pump. The pump is configured to circulate the water within the water receptacle, wherein circulation of the water within the water receptacle ensures that the water within the water receptacle is at a uniform temperature throughout.

Certain embodiments of the present invention provide a method of preventing ice from forming on a surface of water retained within a water receptacle. The method includes detecting a temperature of the water within the water receptacle, heating the water when the temperature is below a first temperature threshold, deactivating the heating when the temperature reaches a second temperature threshold, and continually circulating the water within the water receptacle so that the temperature of the entire volume of water within the water is uniform.

The first temperature threshold may be proximate a freezing point. The continually circulating step may occur during the heating and the deactivating steps. The detecting step may occur proximate a base of the water receptacle. Optionally, the detecting step may occur proximate the surface of the water, such as with respect to a floating deicer.

Figure 1:
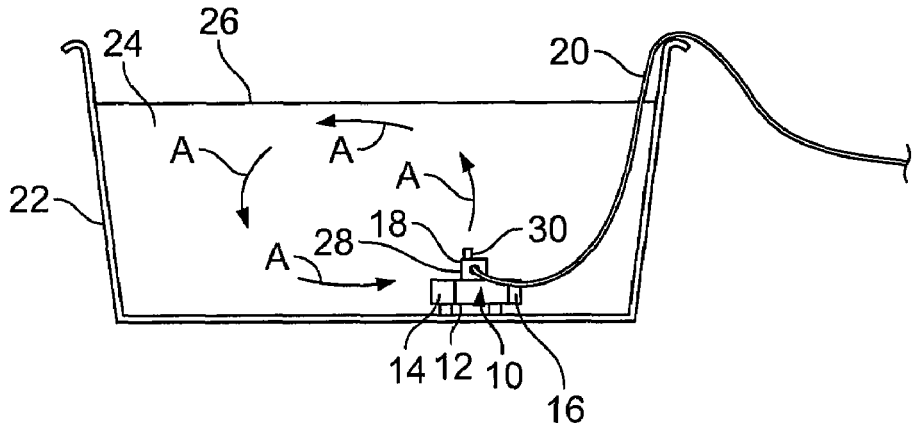
FIG. 1 illustrates a simplified view of a sinking deicing system according to an embodiment of the present invention.

The foregoing summary, as well as the following detailed description of certain embodiments of the present invention, will be better understood when read in conjunction with the appended drawings. For the purpose of illustrating the invention, there are shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a simplified view of a sinking deicing system 10 according to an embodiment of the present invention. The sinking deicing system 10 includes a main body 12 that supports a heating element 14 and a temperature sensor 16. The heating element 14 may be a coil heater, while the temperature sensor 16 may be a thermostat, thermometer, or the like. A fluid pump 18 is secured on, to, and/or within the main body 12. For example, the fluid pump 18 may be disposed on top of the main body 12 above the heating element 14 and the temperature sensor 16. The heating element 14, the temperature sensor 16, and the fluid pump 18 are electrically connected to an insulated power cord 20 that connects the deicing system 10 to a source of power, such as a standard wall outlet. Optionally, the deicing system 10 may be powered by batteries.

Each of the heating element 14, the temperature sensor 16, and the fluid pump 18 may also be electrically connected to a processing unit (not shown) located within, or remotely from, the deicing system 10. The processing unit may be used to control operation of the deicing system 10, such as shown and described in U.S. application Ser. No. 11/733,637, entitled "Fluid Heating System and Method," filed Apr. 10, 2007, which is hereby incorporated by reference in is entirety.

The sinking deicing system 10 is configured to sink to the bottom of an open-ended water receptacle 22, such as a livestock water trough, water tank, or bucket that retains water 24. As shown in FIG. 1, the water receptacle 22 includes a base integrally formed with upright outer walls. A water retention cavity is defined between the base and outer walls. The temperature sensor 16 detects the temperature of the water 24 proximate the deicing system 10. When the temperature sensor 16 detects a temperature in which the water surface 26 is susceptible to freezing, the heating element 14 is activated in order to warm the water 24. After the water 24 is heated to a temperature in which the water surface 26 will not freeze, as detected by the temperature sensor 16, the heating element 14 is deactivated.

The fluid pump 18 significantly reduces the temperature gradient between the bottom of the water 24 proximate the deicing system 10 and the water surface 26. Thus, the deicing system 10 is able to detect the warmed water sooner in order to deactivate the heating element 14 before the water surface 26 is excessively heated.

The fluid pump 18 may be a small pump that circulates 40-150 gallons per hour and consumes a relatively small amount of power (e.g., less than 10 watts per hour). The fluid pump 18 operates to circulate the water 24 within the water receptacle 22 in the direction of arrows A. As such, warmer water near the bottom of the water receptacle 22 is circulated to the water surface 26, thereby warming the water surface 26, while cooler water at the water surface 26 is circulated down toward the deicing system 10, where it is warmed. The fluid pump 18 draws water in through a water inlet or intake 28, and ejects water out through a water outlet 30 in order to provide the circulating water flow within the fluid receptacle 22. The water outlet 30 may be pointed upward in order to establish a circulating fluid current in the fluid receptacle 22. The fluid pump 18 may be continually activated even when the heating element 14 is deactivated. Thus, the water 24 within the fluid receptacle 22 may be continually circulated, thereby warming water at the water surface 26, and circulating cooler water to the bottom of the fluid receptacle where it is warmed through heat exchange with the warmer water at the bottom. Heat retained by the water 24 is spread throughout the fluid receptacle 22 via convection. As such, the fluid pump 18 significantly reduces or eliminates potential temperature gradients within the water 24.

Because the fluid pump 18 circulates the water 24, thereby reducing or eliminating temperature gradients, the temperature detected by the temperature sensor 16 at the bottom of the fluid receptacle 22 will be the same, or substantially the same, as the temperature at the water surface 26. Thus, the heating element 14 may be configured to activate at a point that is much closer to the freezing point of the water 24 at the surface 26 than in previous sinking deicers. That is, the deicing system 10 does not need to take into account temperature gradients in order to set an activating trigger point for the heating element 14. Therefore, the water surface 26 is not excessively heated, and energy is saved due to the heating element 14 being operated more efficiently.

Alternatively, embodiments of the present invention may be used with a floating deicing system, although such a floating deicing system is susceptible to being contacted by animals. For example, the main body 12, the heating element 14, the temperature sensor 16, and the fluid pump may be mounted to, or secured with respect to, a floating member, such as an air filled tube, Styrofoam pontoon or ring structures, or the like. In this embodiment, the heating element 14 and the temperature sensor 16 are disposed within the water 24 (e.g., secured to an underside of the main body 12). The fluid pump 18 is also disposed within the water 24 such that the water outlet 30 would be downwardly oriented toward the base of the fluid receptacle 22 to promote water circulation. The water circulation provides a uniform temperature throughout the water 24, thereby reducing or eliminating temperature gradients.

Figure 2:
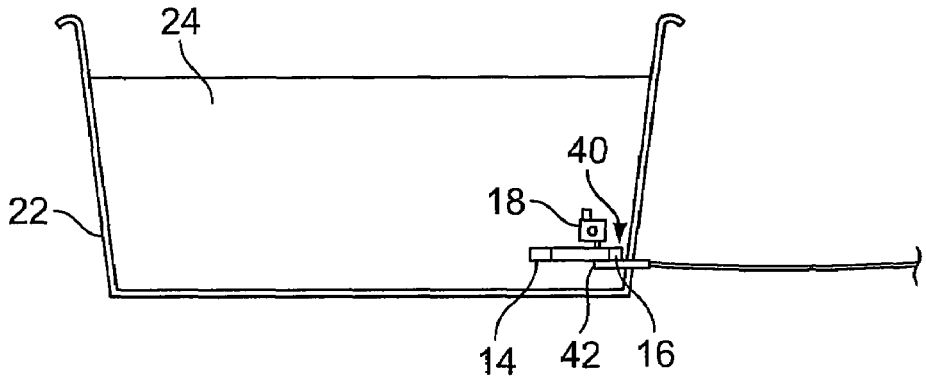
FIG. 2 illustrates a simplified view of a drain plug deicing system according to an embodiment of the present invention.

FIG. 2 illustrates a simplified view of a drain plug deicing system 40 according to an embodiment of the present invention. The drain plug deicing system 40 includes a main body 42 including a drain plug 44 that supports a temperature sensor 16, a heating element 14, and a fluid pump 18. The drain plug is sealingly secured within a drain opening of a fluid receptacle 22 that is configured to retain a fluid, such as water 24. The deicing system 40 operates similarly to the deicing system 10, except that the deicing system 40 is suspended out of a drain, instead of lying submerged at the bottom of the fluid receptacle 22.

Figure 3:
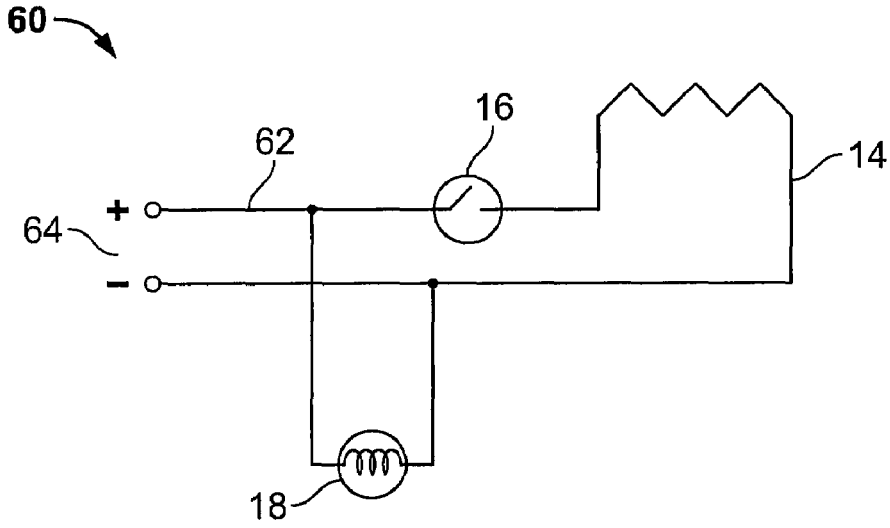
FIG. 3 illustrates a schematic diagram of a deicing circuit according to an embodiment of the present invention.

FIG. 3 illustrates a schematic diagram of a deicing circuit 60 according to an embodiment of the present invention. As shown in FIG. 3, the temperature sensor 16, such as a thermostat, is disposed within an electrical path 62 (which may include electrical wires) between a power source 64 and the heating element 14. The fluid pump 18 is also disposed in the electrical path 62. The temperature sensor 16 may include a switch that selectively closes and opens the electrical path to the heating element 14. Thus, when the temperature sensor 16 detects a warm temperature, the temperature sensor 16 acts to open the switch and deactivate the heating element 14. Conversely, when the temperature sensor 16 detects a cold temperature, the temperature sensors 16 act to close the switch and activate the heating element 14. The pump 18 may be disposed in the electrical path 62 upstream from the temperature sensor 16. As such, any switch within the temperature sensor 16 would not affect the pump 18. Alternatively, the pump 18 may be activated and deactivated along with the heating element 14.

While embodiments of the present invention show deicing systems including a pump 18, embodiments of the present invention may include multiple pumps, or pumps having multiple intakes and outlets. Additionally, while the pump 18 is shown on top of the deicing systems 10 and 40, the pump 18 may be integrally formed with a main body of the deicing systems 10 and 40.

Figure 4:
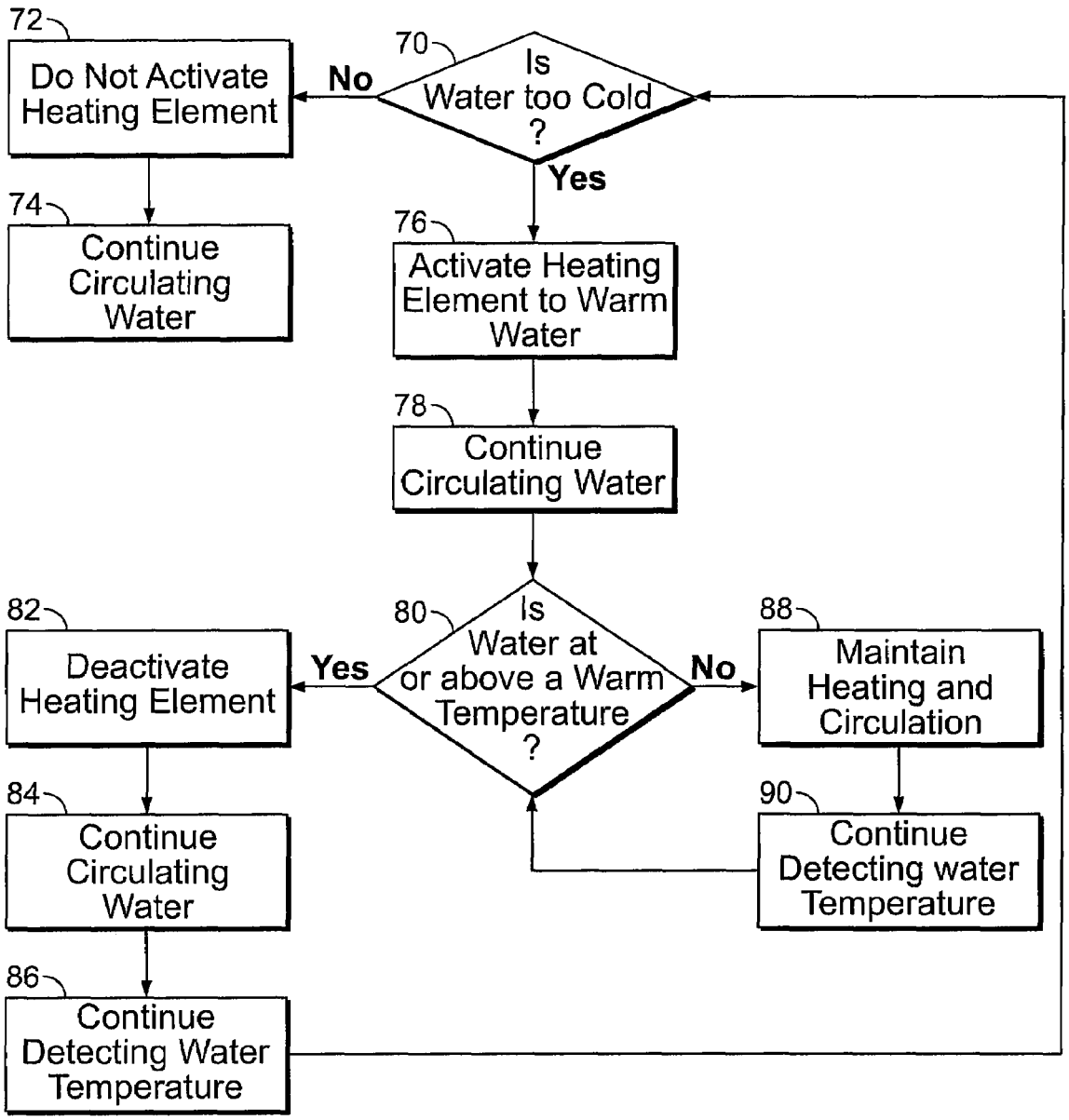
FIG. 4 illustrates a flow chart of a deicing method according to an embodiment of the present invention.

FIG. 4 illustrates a flow chart of a deicing method according to an embodiment of the present invention. At 70, the temperature sensor determines whether the water temperature within a water receptacle, such as a livestock water trough, is too cold. If it is not too cold, the heating element is not activated at 72, while the pump continues to circulate the water at 74.

If the water temperature is too cold (e.g., susceptible to freezing), the heating element is activated at 76 in order to begin warming the water, while the water within the water receptacle continues to be circulated at 78. At 80, the temperature sensor determines if the water is at a warm temperature in which it is not susceptible to freezing. If the water is at a warm temperature, the heating element is deactivated at 82, while the pump continues to circulate the water at 84. At 86, the temperature sensor continues to detect the water temperature to determine if the water cools to a cold temperature at 70, at which point the process repeats.

If at 80, the water is not at a warm temperature, the heating element continues heating the water and the pump continues to circulate the water at 88. The temperature sensor continues to detect the water temperature at 90 to determine if and when the water reaches the warm temperature.

Thus, embodiments of the present invention provide safe and efficient deicing systems and methods of operating such systems. Embodiments of the present invention provide sinking and drain plug deicing systems that are particularly safe to use with respect to open-ended water tanks, such as livestock water troughs, buckets, and basins (i.e., animals are unlikely to contact sinking and drain plug deicing systems). Embodiments of the present invention provide a deicing system that circulates fluid within a fluid receptacle in order to reduce or eliminate temperature gradients.

While various spatial terms, such as upper, bottom, lower, mid, lateral, horizontal, vertical, and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

The invention claimed is:

1. A deicing system configured to heat water within an open-ended water receptacle, the deicing system configured to be positioned proximate a base of the open-ended water receptacle, the deicing system comprising:

a main body configured to be positioned proximate the base of the open-ended water receptacle;

a temperature sensor supported by said main body and configured to detect a temperature of the water;

a heating element supported by said main body and configured to heat the water when the temperature of the water approaches a first temperature threshold as measured by said temperature sensor, said heating element configured to deactivate when the temperature of the water exceeds a second temperature threshold as measured by said temperature sensor, wherein said second temperature threshold is higher than the first temperature threshold; and a pump supported by said main body and configured to circulate the water within the water receptacle to prevent temperature gradients within the water.

2. The deicing system of claim 1, wherein said main body is configured to be submerged in the water receptacle.

3. The deicing system of claim 1, further comprising a drain plug that connected to said main body, wherein said drain plug is configured to be sealingly secured within a drain of the water receptacle.

4. The deicing system of claim 1, wherein said pump comprises a water intake configured to draw the water into said pump, and a water outlet configured to eject the water.

5. The deicing system of claim 4, wherein said water outlet is upwardly directed.

6. The deicing system of claim 1, wherein the open-ended water receptacle is a livestock water trough.

7. The deicing system of claim 1, further comprising a switch disposed between said heating element and said temperature sensor.

8. The deicing system of claim 1, wherein said heating element is a heater coil.

9. The deicing system of claim 1, wherein said temperature sensor is a thermostat.

10. The deicing system of claim 1, wherein said pump is configured to run when said heating element is activated and deactivated.

11. A system for preventing ice from forming on a surface of water, the system comprising:

an open-ended water receptacle having a base and outer walls, wherein a water retention cavity is defined between said base and said outer walls, said open-ended water receptacle configured to retain water within said water retention cavity; and a deicer positioned proximate said base, said deicer configured to maintain the water at a uniform temperature within said open-ended water receptacle, said deicer comprising:

a main body;

a temperature sensor supported by said main body, said temperature sensor configured to detect a temperature of the water within said water receptacle;

a heating element supported by said main body, said heating element configured to heat the water based on the temperature detected by said temperature sensor; and a pump supported by said main body, said pump configured to circulate the water within said water receptacle, wherein circulation of the water within said water receptacle ensures that the water within said water receptacle is at a uniform temperature throughout.

12. The system of claim 11, wherein said main body is configured to be submerged in said water retention cavity.

13. The system of claim 11, further comprising a drain plug connected to said main body, and wherein said drain plug is configured to be sealingly secured within a drain formed in at least one of said outer walls of said open-ended water receptacle.

14. The system of claim 11, wherein said pump comprises a water intake configured to draw the water into said pump, and a water outlet configured to eject the water, and wherein said water outlet is upwardly directed.

15. The system of claim 11, wherein the open-ended water receptacle is a livestock water trough.

16. The system of claim 11, wherein said pump is configured to run when said heating element is activated and deactivated.

17. A method of preventing ice from forming on a surface of water retained within a water receptacle, the method comprising:

detecting a temperature of the water within the water receptacle proximate a base of the water receptacle;

heating the water proximate the base of the water receptacle when the temperature is below a first temperature threshold;

deactivating said heating when the temperature reaches a second temperature threshold; and continually circulating the water within the water receptacle so that the temperature of the entire volume of water within the water is uniform.

18. The method of claim 17, wherein the first temperature threshold is proximate a freezing point.

19. The method of claim 17, wherein said continually circulating occurs during said heating and said deactivating.

20. The deicing system of claim 1, wherein the deicing system is configured to be positioned proximate the base of the open-ended water receptacle at all times during operation, and wherein said main body is configured to be positioned proximate the base of the open-ended water receptacle at all times during operation.

21. The system of claim 11, wherein said deicer is positioned proximate said base at all times during operation.

* * * * *